US006178977B1

(12) United States Patent
Wells

(10) Patent No.: US 6,178,977 B1
(45) Date of Patent: Jan. 30, 2001

(54) DEVICE FOR CLEANING DEPOSITS FROM AN INTERNAL COMBUSTION ENGINE

(76) Inventor: Jerry Lee Wells, 32216 107th Pl. Southeast, Auburn, WA (US) 98092

( * ) Notice: Under 35 U.S.C. 154(b), the term of this patent shall be extended for 0 days.

(21) Appl. No.: 09/131,581

(22) Filed: Aug. 10, 1998

(51) Int. Cl.[7] ..... B08B 3/08
(52) U.S. Cl. ..... 134/102.1; 134/169 A
(58) Field of Search ..... 134/169 A, 102.1, 134/102.2

(56) References Cited

U.S. PATENT DOCUMENTS

| | | | | |
|---|---|---|---|---|
| 4,520,773 | * | 6/1985 | Koslow | 134/123 |
| 4,989,561 | * | 2/1991 | Hein et al. | 134/169 A |
| 5,833,765 | * | 11/1998 | Flynn et al. | 134/22.12 |
| 5,970,994 | * | 10/1999 | Sasaki et al. | 134/102.1 |
| 6,000,413 | * | 12/1999 | Chen | 134/102.2 |

* cited by examiner

*Primary Examiner*—Jeffrey Snay
(74) *Attorney, Agent, or Firm*—Kerry Kampschmidt

(57) ABSTRACT

The present invention describes a method and device for cleaning the components of an internal combustion engine. The device provides a single valve for regulating the flow and blend of air and cleaning fluid entering the combustion chamber of an internal combustion engine. The invention provides a novel device and process for cleaning mineral deposits from the surface of the combustion chamber, piston crown and intake ports, intake valves. The flow control valve is capable of regulating the flow of air and cleaning fluid into the combustion chamber of an internal combustion engine during the cleaning process. The device of the present invention connects two separate hoses to a flow control valve. The end of one of the hoses is placed within a reservoir of cleaning fluid. The end of the other hose is connected to vacuum port of an internal combustion engine. Thus, the device provides a path for the cleaning fluid to pass from the reservoir through the flow control valve, through the vacuum port of the engine, through the intake manifold onto the combustion chamber, and out the engine's exhaust.

6 Claims, 5 Drawing Sheets

DEVICE FOR CLEANING DEPOSITS FROM AN INTERNAL COMBUSTION ENGINE

TECHNICAL FIELD

This invention relates to methods and devices for cleaning deposits from internal combustion engines. More particularly, this invention relates to cleaning components of internal combustion engines utilizing the air intake system to remove carbonateous materials, including gum deposits, varnishes, tars, carbon deposits and similar materials therefrom by passing a cleaning solution through the combustion chamber of the engine. Specifically, this invention relates to a device created to utilize an internal combustion engine's vacuum to draw a mixture of air and cleaning fluid into and through the engine's combustion chamber in addition to the fuel, thereby cleaning the intake valve chambers, valves and combustion chamber in the process. More specifically, this invention relates to the method and device for creating a mixture of air and cleaning fluid to pass through the engine's vacuum port to and through the engine's combustion chamber.

BACKGROUND OF THE INVENTION

The detergents used in gasoline, to keep fuel injectors clean, have tended to increase deposits on the engine's intake valves, intake ports, the piston crown and the combustion chamber. Deposits on an engine's intake valves, intake ports, piston crown and combustion chamber decrease the engine's performance. An engine's intake valves, intake ports, pistons, and combustion chambers are manufactured to extremely fine tolerances; even microscopic foreign particles within the engine tend to result in malfunction and poor performance. Poor fuel quality, as well as ordinary conditions tend to be responsible for the accumulations of varnishes, carbon, and other contaminates of the type described.

Deposits behind intake valves and intake ports restrict air flow and cause the fuel charge to be rich. This causes difficulty starling an engine, uneven running, power loss, and increased emissions. Hard deposits around the intake valves prevent the valves from seating properly. This causes compression loss, which cause difficult starting in cold weather, poor acceleration, lack of power and increased emissions of hydrocarbons. Post combustion deposits on the piston crown and in the combustion chamber prevent the valves from seating properly and cause hot spots, which lead to knocking and pinging and raise combustion temperatures that lead to increased emissions. These deposits must be removed periodically if continued optimum performance of the engine is to be achieved.

Prior art methods of introducing cleaning fluids into the engine have been developed. Some of these methods involved blocking off the engines fuel supply and introducing a pressurized canister of cleaning fluid. Other methods utilized the engine's vacuum port to draw cleaning fluid into the combustion chamber. These methods of drawing the cleaning fluid into the combustion chamber by the vacuum created by the engine generally resulted in stalling of the engine. These methods utilized a vacuum hose connected between the engine's vacuum port and a container of cleaning fluid. The hose used to siphon the fluid from the container to the engine generally had a shut off valve to start and stop the flow. With the engine turned on, a vacuum was created at the vacuum port. The engine vacuum would siphon the cleaning fluid from the reservoir, immediately upon opening the shut off valve. This immediate flow of cleaning fluid into the combustion chamber tended to lower the engine's idle speed. Furthermore, the sudden increase in the amount of fluids in the combustion chamber reduces the ability of the fuel to ignite and burn and often cause the engine to stall. These prior art methods of introducing cleaning fluid into the combustion chamber required multiple attempts in order to draw all the cleaning fluid through the engine.

Also, these prior methods failed to release the flowing pressure in the event of an engine stalling. The siphon flow created by the engine's vacuum was not released when the engine stalled. The flow continued until the combustion chamber was filled with the cleaning fluid. The continued flow into the stalled engine can cause damage to the engine.

One advantage of the present invention is that it releases the siphon created by the engine upon abrupt stoppage of the engine. The continued flow into the stalled engine can cause damage to the engine.

Another advantage of the present invention is that it provides the ability to mix cleaning fluid with air before the mixture enters the combustion chamber. Still another advantage of the present invention is that it provides a means for regulating the amount of fluid passing into the combustion chamber.

Another advantage of the present invention is that it provides a means to increase the idle speed of the engine prior to the mixture of fluid entering the combustion chamber.

Another advantage of the present invention is that it draws a mixture of air and cleaning fluid through a vacuum port of the engine into the combustion chamber to remove combustion deposits within the engine.

Still another advantage of the present invention that it draws a mixture of air and cleaning fluid through the combustion chamber and prevents contacting harsh cleaning chemicals with fuel injector's during the cleaning process. Aggressive cleaning chemicals can attack some injector's that are made of plastic.

Another advantage of the present invention that is removes pre-combustion deposits behind intake valves. These pre-combustion deposits restrict the flow of air to the cylinder causing difficult starting, uneven running, power loss, and increased emissions of nitrous oxides.

Another advantage of the present invention is that it removes hard deposits around the intake valves. Hard deposits around the intake valves prevent the valves from seating properly. This causes compression loss, which causes difficult starting in cold weather, poor acceleration, lack of power and increased emissions of hydrocarbons.

Another advantage of the present invention is that it removes post combustion deposits on the piston crown and in the combustion chamber. Post combustion deposits on the piston crown and in the combustion chamber prevent the valves from seating properly and cause hot spots. These hot spots can cause knocking and pinging and raise combustion temperatures and increased emissions.

SUMMARY OF THE INVENTION

The present invention provides a method and device for drawing a controllable mixture of air and cleaning fluid into the combustion chamber of an internal combustion engine. The invention provides a novel device and process for cleaning mineral deposits from the surface of the combustion chamber, piston crown, intake ports, and intake valves.

The present invention provides a device with a valve capable of creating and regulating a mixed flow of air and cleaning fluid and transferring the flow into the combustion chamber of an internal combustion engine. The device of the present invention includes two hoses connected to a valve. The end of one of the hoses is placed within a reservoir of cleaning fluid. The end of the other hose is connected to a vacuum port of an internal combustion engine. Thus, the device provides a path for the cleaning fluid to pass from the reservoir through the flow control valve, through the vacuum port, through the combustion chamber, and out the engine's exhaust.

The flow control device of the present invention has two intake ports and one exhaust port. The first intake port is connected to a hose placed within a fluid reservoir and a second intake is open to the atmosphere to allow air to enter the device. The exhaust port allows the mixture to exit the device's valve chamber. The device has a gate capable of preventing flow, allowing flow of only air, allowing flow of a mixture of air and fluid, or allowing flow of only fluid through the valve.

The device of the present invention connects between the fluid reservoir and a vacuum port of the engine. With the valve's gate set to the closed position, no flow is allowed through the device. At this setting the engine is started. The valve prevents flow of air and fluid into the engine through the engaged vacuum port.

Next, the gate of the flow control valve of the present invention is turned allowing flow of only air through the device. The increase in air into the combustion chamber leans the engine's fuel mixture, with the result of an increase of the idle speed. The increase in idle speed tends to prevent the engine from stalling when the cleaning fluid is introduced into the combustion chamber.

Next, the gate of the flow control valve of the present invention is turned further allowing flow of a mixture of mostly air and a small amount of cleaning fluid through the device. The increase in engine's idle speed helps pass the mixture through the combustion chamber.

Next, the gate of the flow control valve of the present invention is turned further allowing more cleaning fluid to pass through the device. This allows for a mixture most suitable for any given engine. This flow is continued until the reservoir of cleaning fluid is emptied. The process of passing the mixture through the engine's combustion chamber cleans the carbonateous materials, including deposit gums, varnishes, tars, carbon deposits and similar materials from the engine.

The device of the present invention, also, provides a means to stop the siphon flow if the engine stalls. The control valve's air intake port introduces air at the reservoir end of the flow equalizing the pressure instantly upon discontinuance of the vacuum pressure. Thus, the flow stops instantly when the engine stops and the combustion chamber does not fill with cleaning fluid.

DETAILED DESCRIPTION

Figure 1:
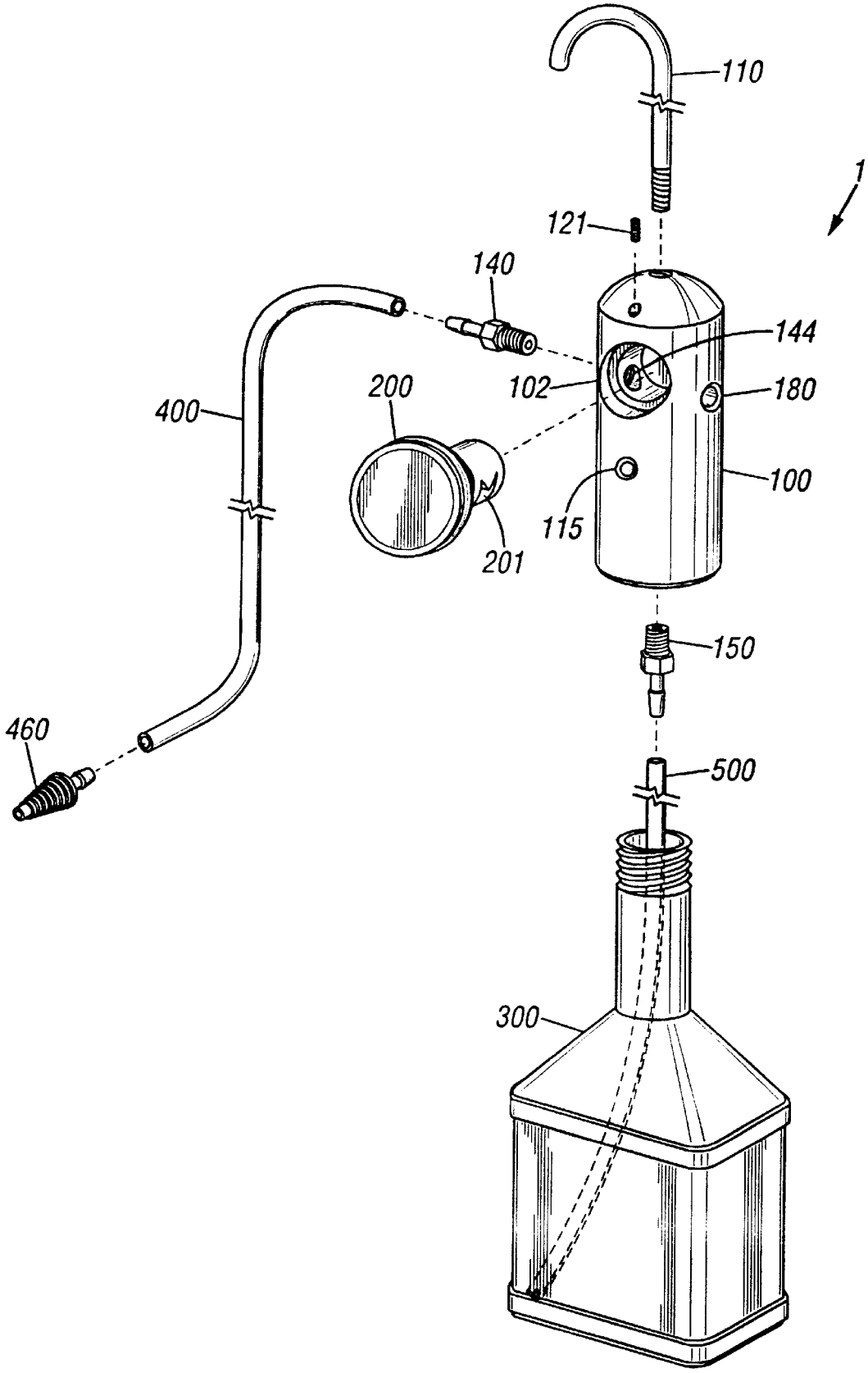
FIG. 1 is an exploded isometric exterior view of a device for cleaning deposits from an internal combustion engine.

FIG. 1 shows an exploded view of a device 1 for providing a mixture of air and fluid to an internal combustion engine. The device consists of five main components including a valve body 100, a valve gate 200, a fluid reservoir 300, a valve exhaust hose 400, and a fluid reservoir hose 500. Hose 400 connects to valve body 100 at port 144. Hose 500 connects to valve body 100 at port 156, shown in FIG. 4. Preferably, hose 400 and hose 500 are joined to the valve body 100 by sub-components including a valve exhaust fitting 140 and a valve reservoir hose fitting 150, respectively. The valve exhaust fitting 140 and the valve reservoir hose fitting 150 are hollow to allow fluid passage. The remaining sub-components shown in FIG. 1 include valve body hook 110, valve gate set 121, and engine intake connect 460.

Valve body 100, valve body hook 110, valve gate 200, valve exhaust fitting 140, engine intake connect 460, and valve reservoir hose fitting 150 can be constructed of any inert material such as die cast aluminum, stainless steel or preferably, high density polyethylene, commonly referred to as HDPE. Valve exhaust hose 400 and valve reservoir hose 500 can be made of a flexible plastic material, polyetheyne or preferably, vinyl. Fluid reservoir 300 is made of a rigid plastic material.

Figure 2:
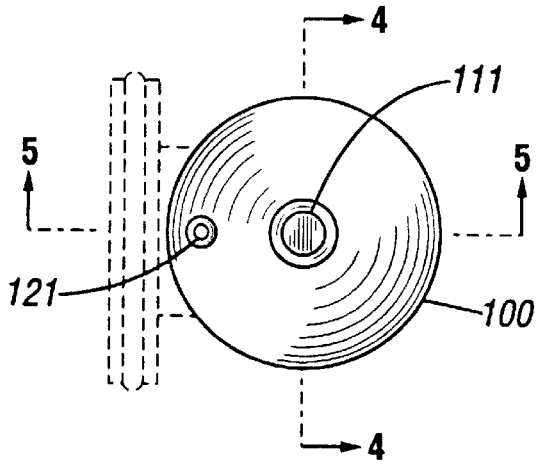
FIG. 2 is a top view of the valve body.

FIG. 2 shows the top view of the valve body with cross-section lines indicated. A valve hook hole 111 is shown in the top of the valve body 100 to engage the valve hook 110. Preferably, the valve hook 110 is threaded to screw into a threaded hook hole 111.

Figure 3:
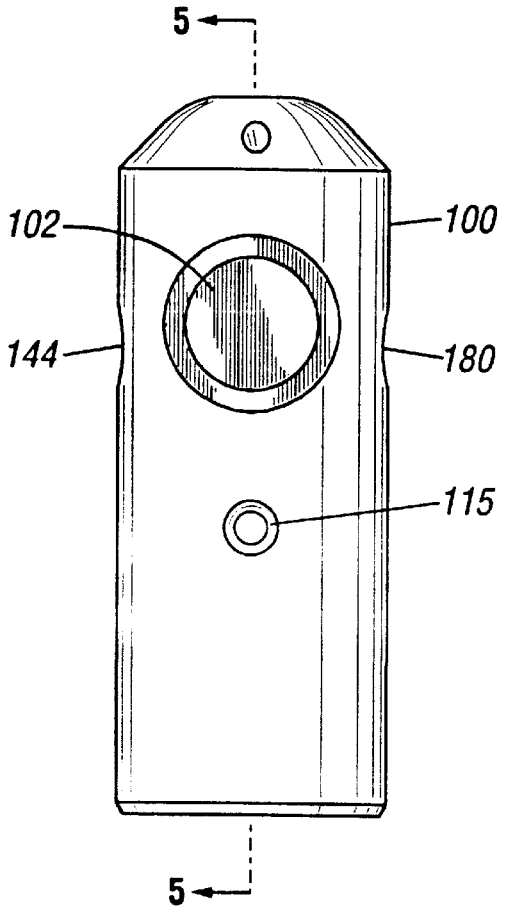
FIG. 3 is a front side view of the valve body.
Figure 5:
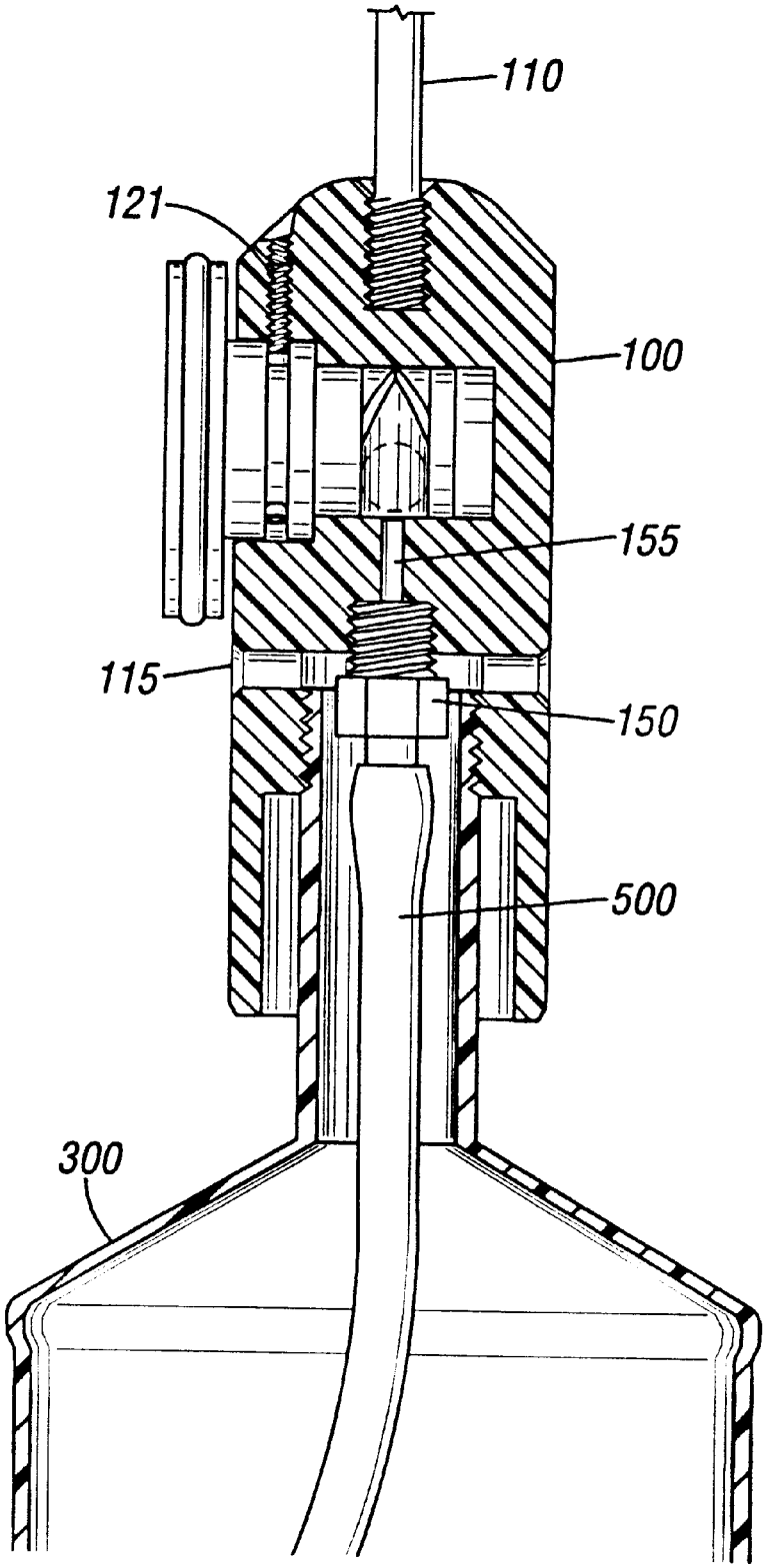
FIG. 5 is a partial cross-sectional view of the valve body along line 5—5.

FIG. 3 shows a side view of the valve body 100 looking into a valve chamber 102. A air vent inlet passage 115 is shown. FIG. 5 shows air vent inlet passage 115 passing from the exterior of the valve body 100 to passageway 157. Air vent inlet passage 115 allows air to enter into reservoir 300 to replace the cleaning solution, as the cleaning solution is drawn out of reservoir 300.

Figure 4:
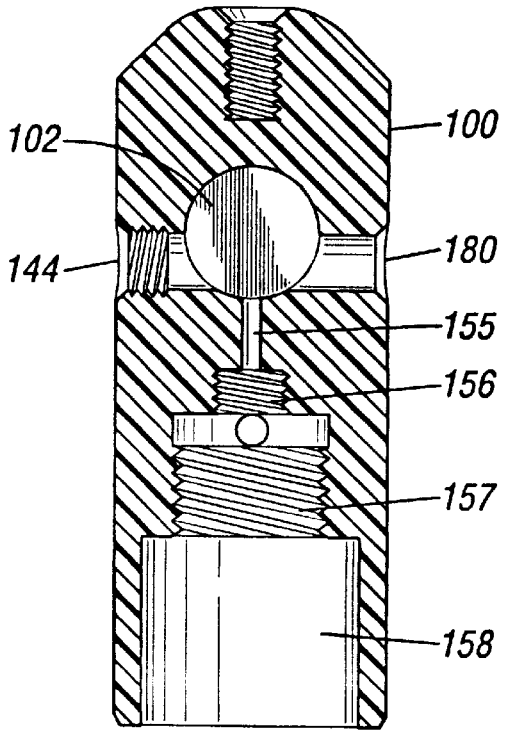
FIG. 4 is a cross-sectional view of the valve body along line 4—4

FIG. 4 shows a cross sectional view of the valve body 100 along line 4—4 showing an air inlet port 180 passing from the exterior of the valve body 100 into the valve chamber 102. Valve chamber exhaust port 144 and air inlet port 180 are shown as a continuous bore through valve body 100 passing through valve chamber 102. Preferably, the valve chamber exhaust port 144 is partially threaded to engage a threaded valve exhaust fitting 140. Fluid inlet port 155 passes longitudinally into valve body 100 and enters valve chamber 102. Fluid inlet port 155 is shown as a central bore of valve body 100 perpendicular to the bore of port 144 and port 180.

FIG. 4 shows four parallel central bores with incrementally stepped decreasing diameters. The reservoir bore 158 has the largest diameter and extends from the exterior of the valve body 100 to a reservoir connection passage 157. The reservoir connection passage 157 extends into the valve body 100 to a hose fitting passage 156. The hose fitting passage 156 extends into the valve body 100 to the fluid inlet port 155. The fluid inlet port 155 enters valve chamber 102.

FIG. 5 shows reservoir connection passage 157 threaded to engage a threaded top on the fluid reservoir 300. Hose fitting passage 156 is shown threaded to engage a partially threaded valve reservoir hose fitting 150. Preferably, valve reservoir hose fitting 150 and valve exhaust hose fitting 140 are each threaded at one end, have a 7/16 bolt head turn mid section, and a 1/8 inch National Pipe Thread (NPT) by 1/4 inch tube connector for 0.25 ID tube press fitting hose connection at their other ends. Reservoir hose 500 presses onto the conical press fitting of hose fitting 150 and exhaust hose 400 presses onto the conical press fitting of hose fitting 140. Preferably, fitting 150 is threaded into passage 156.

FIG. 5 shows a partial cross sectional view of the valve body along line 5—5. In FIG. 5, hose 500 is shown inside reservoir 300. The assembled device 1 provides a fluid passage from reservoir 300 through reservoir hose 500 into valve chamber 102. Similarly, exhaust hose 400 provides a passage from exhaust port 144 to a vacuum port of an internal combustion engine, such as a brake booster, check valve, or any positive crankcase ventilation ("PCV") port. Preferably, hose 400 connects to the vacuum port closest to the throttle body.

Gate 200 rotates within chamber 102 to functionally open and close port 144 and port 180. Opening port 144 allows the engine's intake of air to create a flow of air through hose 400 and chamber 102. Gate 200 is shown by way of example, in a preferred embodiment, those skilled in the art should recognize that many mechanisms to functionally open and close ports 144 and 180 could be substituted for gate 200.

Figure 6:
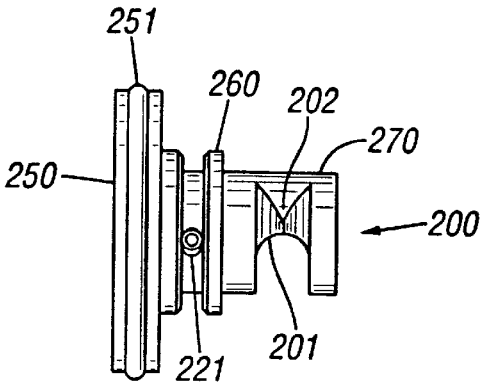
FIG. 6 is a right side plan view of the valve gate.
Figure 7:
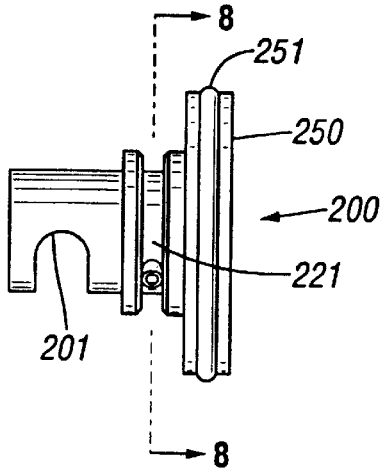
FIG. 7 is a left side plan view of the valve gate.
Figure 8:
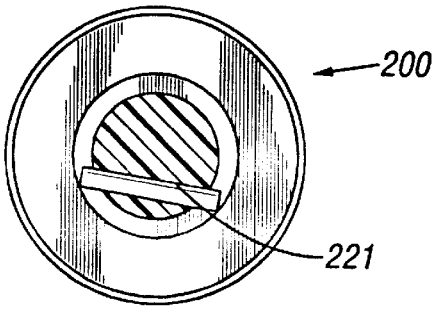
FIG. 8 is a cross-sectional view of the valve gate along line 8—8.
Figure 9:
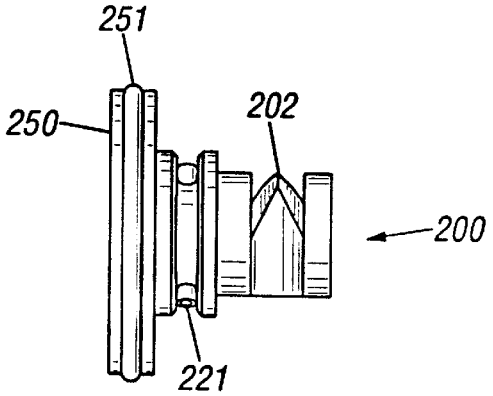
FIG. 9 is an additional view of the valve gate showing the valve obstruction point.

FIG. 6 shows a right side plan view of valve gate 200. Preferably, valve gate 200 has three stepped sections of decreased diameter including an exterior knob portion 250, a set portion 260, a valve chamber portion 270. As shown, knob 250 is grooved along its circumference to accommodate an O-ring 251 for easy handling of valve gate 200. Set portion 260 is grooved along its circumference. Valve body set 121 fits within the groove of set portion 260, as can be seen more clearly in FIG. 5. Valve body set 121 engages valve gate set 221 at specific rotations of gate 200. FIG. 8 shows valve gate set 221 within set portion 260. FIGS. 6, 7 & 9 show alternate views of valve gate set 221 within set portion 260.

Gate 200 is provided with channel 201. Rotation of gate 200 opens and closes port 144 and port 180 by obstructing the passageway through the bore from port 144 to port 180. At a specific rotation of gate 200 within chamber 102, channel 201 becomes co-linear with the bore from port 144 to port 180; this rotation is called the Open Rotation position. Thus, at the Open Rotation position, the bore from port 180 to port 144 is unobstructed by gate 200. Channel 201 is notched on the air intake side, as shown in FIG. 6 and FIG. 9. The notch of channel 201 produces obstruction point 202. Obstruction point 202 partially obstructs port 180 as gate 200 rotates within chamber 102.

At zero degrees rotation of gate 200, gate 200 completely blocks exhaust port 144. This rotation is called the Initial Rotation position. Preferably, gate set 221 engages body set 121 at the Initial Rotation position. Rotating gate 200 clockwise brings channel 201 into the Open Rotation position. Preferably, gate 200 is rotated 65 degrees clockwise from the Initial Rotation position to bring channel 201 into Open Rotation position.

Turning gate 200 clockwise beyond the Open Rotation position rotates obstruction point 202 into the passageway of air intake port 180. Thus, obstruction point 202 partially blocks port 180. Preferably, when gate 200 is rotated 95 degrees it obstructs one half of the area available for entrance to chamber 102 through port 180. At a specific rotation of gate 200 past the Open Rotation position, gate 200 blocks the entire area of port 180; this rotation is called Closed Rotation position. Preferably, the second end of valve set 221 engages body set 121 at Closed Rotation position. Preferably, gate 200 is rotated 185 degrees clockwise from Initial Rotation position to reach the Closed Rotation position. At all clockwise rotations of gate 200 from the Open Rotation position to the Closed Rotation position, channel 201 provides a passageway from fluid inlet port 155 to exhaust port 144.

Figure 10:
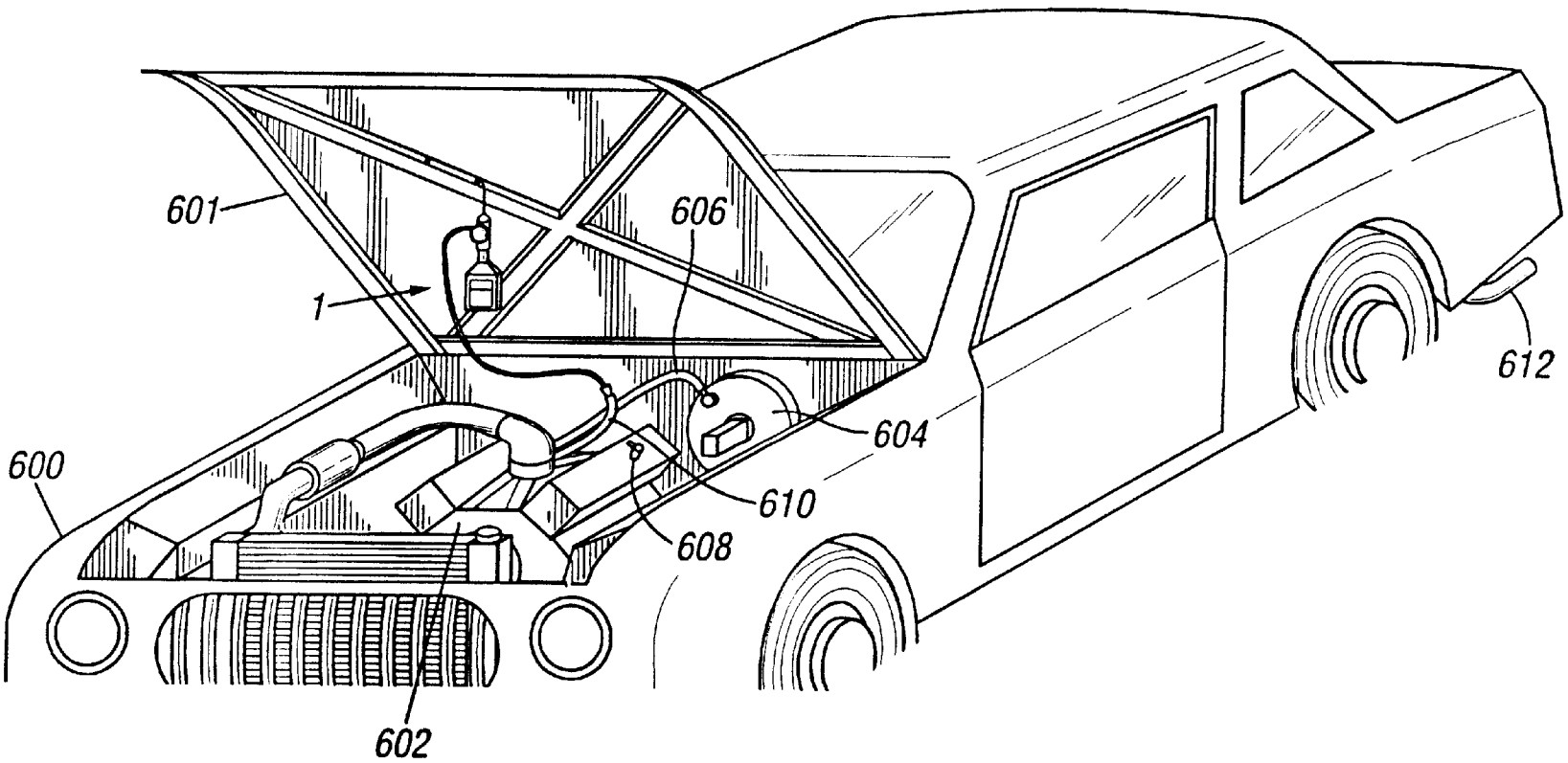
FIG. 10 is a view of the device in use with engine connection points indicated.

FIG. 10 shows device 1 supported by hook 10 from the hood 601 of an automobile 600. With the engine 602 stopped, a vacuum hose 610 is disconnected from a port 608. Engine connect 460 is connected to vacuum hose 610 leading to the combustion chamber of the engine 602. Engine connect 460 can be connected to any vacuum port, hose or line leading to the combustion chamber of an engine, including the brake booster, check valve, or any other vacuum port that goes into the intake manifold near the throttle body or carburetor of the engine. Preferably, engine connect 460 has a 0.016 inch inside diameter with a 1/4 hose connector press fitting hose connection at one end and is tapered conically at the other end to wedge or fit snugly within different sized ports, hose fittings, or hoses of an engine. Preferably, engine connect 460 has the smallest inside diameter of all fluid passages of device 1.

Fluid reservoir 300 is filled with an engine cleaning solution, such as twelve fluid ounces of Bardahl Combustion Cylinder Cleaner ("CCC") or any other cleaner designed to clean combustion chambers, valves, or injectors. Hose 500 is placed within reservoir 300. Valve gate 200 is rotated to the Initial Rotation position.

Engine 602 is started and run at idle speed. Idle speed is generally between 700 rpm to 1,000 rpm. Preferably, the engine should be running at the lowest rpm possible while still running smoothly. The running engine 602 will create a vacuum within device 1. With gate 200 rotated to the Initial Rotation position, port 144 is blocked and no flow is allowed through chamber 102.

Next, gate 200 is slowly turned to the Open Rotation position. The running engine draws air from port 180 through chamber 102 across port 155. Preferably, the air flow velocity at the Open Rotation position does not create sufficient hydraulic pressure within hose 500 to draw the fluid from reservoir 300.

The increase in air in the engine's combustion chamber leans the fuel mixture and increases the engine's idle speed. The engine's idle speed increases between 100 to 300 RPM due to the increased air flow, preferably the increase is 200 RPM.

Rotating gate 200 further clockwise past the Open Rotation position restricts the available entrance area of port 180. The restriction of the available entrance area increases the flow velocity across port 155 and thus, creates a differential pressure from ambient. Preferably, when the available entrance area of port 180 is restricted by one half the velocity across port 155 is sufficient to create a flow from reservoir 300.

A mixture of air and cleaning fluid from reservoir 300 are drawn into the engine and pass through the combustion chamber. The flow of cleaning fluid through the engine causes minute particles of carbonateous materials, including gum deposits, varnishes, tars, carbon deposits and similar materials on the intake ports, intake valves, piston crown and combustion chamber to dislodge. The dislodged particles enter the stream of air, pass through the combustion chamber and exhaust from the engine. The cloud of particulate matter exhausting from engine exhaust 612 should be noticeable to the eye.

As gate 220 is rotated clockwise obstruction point 202 further obstructs the passageway through port 180. As less air is allowed to enter chamber 102, the ratio of cleaning fluid increases in the mixture entering the combustion chamber. The flow of cleaning fluid from reservoir 300 creates a siphon through hose 500 that continues into the combustion chamber. At this point, gate 200 is rotated further clockwise to reach the optimum air/cleaning solution ratio.

The optimum air/fluid ratio is when the engine is idling steadily and there are very few emissions from the engine exhaust 612. Preferably, hose 400 is a clear tube through which the fluid mixture can be seen. A mist of bubbly almost colorless air and cleaning fluid can be seen flowing through hose 400 at the optimum air/fluid ratio.

The adjustment of gate 200 is controlled by the operator according to the conditions the operator observes. As gate 200 is rotated past the Open Rotation position, if the engine rpm's drop or excessive quantities of black smoke are exhausting, it is a sign that the mixture is to rich and the engine could stall. Increasing the air in the mixture will lean the mixture, the engine ipm's will return to idle, and the black smoke emissions will be reduced.

For most engines, a 500 ml bottle should be emptied and the cleaning procedure completed in approximately fifteen to twenty minutes. This length of time is approximate. The time depends on the size of the engine and its idle speed and the vacuum it draws. Engines creating different vacuum pressures will require different times.

After reservoir 300 is emptied the engine is stopped, the engine connect 460 is disconnected and the disengaged vacuum hose 610 is reconnected to port 608. The engine is restarted and run for a short period of time at a fast idle to further flush or remove the particulate material from the combustion chamber. Preferably, the engine is run for two to three minutes at fast idle. Next, the vehicle is driven for two to three miles. Driving the vehicle raises the temperature in the combustion chamber and bums off any remaining deposits that have absorbed cleaning fluid.

If the engine stalls or otherwise is abruptly stopped during the process of the present invention, the siphon pressure is automatically released by device 1 through the entry of ambient air at port 180 and port 115. The entry of ambient air prevents the siphon flow into the combustion chamber when the engine stops. Such a flow of a fluid into the combustion chamber of an engine after stopping could damage the engine rods, pistons, or crankcase when the engine is restarted.

In a preferred method, a vacuum hose 610 closest to the throttle body of the engine 602 is disconnect from its connection. The cap of a 500 ml bottle of Bardahl CCC or another combustion chamber cleaning fluid is removed. The bottle is screwed into passage 157 of device 1. Device 1 is hung from a support structure above the engine 602. A clear vinyl hose connects the hanging device 1 to engine connect 460.

Engine connect 460 is connected to the disconnected vacuum hose 610 leading to the intake manifold and onto the combustion chamber of the engine 602. With gate 200 in the Closed Rotation position, the engine is started. Engine 602 is run at the lowest rpm that allows the engine to run smoothly.

Next, gate 200 is slowly but steadily rotated in a clockwise direction past the Open Rotation position until a mist of bubbly almost colorless air and cleaning fluid can be seen flowing through hose 400. The flow of cleaning fluid is continued until reservoir 300 is emptied. Gate 200 is rotated counter-clockwise to the Initial Position.

The engine is stopped. Engine connect 460 is disconnected and the disconnected vacuum hose 610 is reconnected to port 608. The engine is restarted and run for two to three minutes at a fast idle. Next, the vehicle is driven for two to three miles.

The present invention described herein is for purpose of a preferred embodiment only. Those skilled in the art should understand that many changes in design, configuration and dimension are possible without departing from the spirit and scope of the invention.

What is claimed is:

1. A device for manual operation of cleaning deposits from an internal combustion engine, said device designed to attach to a vacuum port of said engine to draw air through said device with said engine operating, said device allows air flow into the engine before drawing cleaning fluid into said device to mix with air creating a mixture that is channeled through a combustion chamber of said engine, said device comprising:

a housing having a cavity defining a chamber; said chamber having an air passageway extending completely through said housing, from an inlet side of said housing through said chamber to an exit side of said housing; said inlet side of said air passageway defining an air inlet port at entry of said chamber, and said air passageway defining an exit port at exit of said chamber;

a source of cleaning fluid below said chamber;

a cleaning fluid passageway extending from bottom of said chamber through said housing; entry of said cleaning fluid passageway into said chamber defining a cleaning fluid passageway port;

a conduit from said source to said cleaning fluid passageway port, a valve fitted within said housing chamber capable of obstructing said air passageway within said chamber, wherein said valve operates a rotational manner from a closed position completely obstructing said exit port; said valve is operated by a knob; rotating said knob moves said valve through positions partially obstructing said exit port but not obstructing said air inlet port, and through positions not obstructing said exit port but obstructing said air inlet port; whereby with said engine operating said valve thereby governs flow of air drawn through said chamber;

a fluid exit hose communicating with said exit side of said air passageway providing fluid communication to said engine vacuum port; wherein with said fluid exit hose connected to said vacuum port of said operating engine, rotating said valve from said closed position draws air across said fluid port, and further rotation of said valve through positions obstructing said air inlet port create a siphoning of said cleaning fluid into said chamber to mix with air before entering said combustion chamber of said operating engine.

2. The device of claim 1 in which said fluid exit hose is clear to allow an operator to see said mixture therein.

3. The device of claim 2 in which said fluid exit hose is connected to said housing with a fluid exit coupling; and said conduit is connected to said fluid cleaning passageway with a conduit coupling.

4. The device of claim 3 in which said fluid exit hose is connected to said engine vacuum port by a conically shaped connector.

5. The device of claim 4 in which said air passageway passes through said housing along a continuous bore line.

6. The device of claim 4 in which said source is a bottle of cleaning fluid adapted for threaded engagement to said housing.

* * * * *